US008347435B2

(12) United States Patent
Yu

(10) Patent No.: US 8,347,435 B2
(45) Date of Patent: Jan. 8, 2013

(54) PILLOW WITH POSITIONABLE INSERTS

(76) Inventor: Chang Jun Yu, Mount Prospect, IL (US)

( * ) Notice: Subject to any disclaimer, the term of this patent is extended or adjusted under 35 U.S.C. 154(b) by 0 days.

(21) Appl. No.: 13/072,682

(22) Filed: Mar. 26, 2011

(65) Prior Publication Data

US 2011/0252567 A1 Oct. 20, 2011

Related U.S. Application Data

(60) Provisional application No. 61/325,345, filed on Apr. 18, 2010.

(51) Int. Cl.
*A47G 9/10* (2006.01)

(52) U.S. Cl. ..... 5/640; 5/639; 5/645; 5/490

(58) Field of Classification Search ..... 5/636, 637, 5/639, 640, 643–645, 490, 723, 730, 922; D6/601
See application file for complete search history.

(56) References Cited

U.S. PATENT DOCUMENTS

| | | | | |
|---|---|---|---|---|
| 3,243,828 | A * | 4/1966 | McCarty | 5/636 |
| 4,756,090 | A * | 7/1988 | Pedrow | 33/512 |
| 4,771,493 | A * | 9/1988 | Park | 5/637 |
| 5,360,017 | A * | 11/1994 | Austin | 5/640 |
| 5,727,266 | A * | 3/1998 | Pang | 5/490 |
| 6,256,818 | B1 * | 7/2001 | Hughes | 5/639 |
| 6,481,031 | B1 * | 11/2002 | Hwang | 5/636 |
| 6,981,288 | B1 * | 1/2006 | Hu | 5/636 |
| 6,993,800 | B2 * | 2/2006 | Greenawalt et al. | 5/636 |
| 7,032,264 | B2 * | 4/2006 | Funatogawa | 5/636 |
| 7,571,504 | B2 * | 8/2009 | Kuo | 5/724 |
| 2008/0134438 | A1 | 6/2008 | Park | |

FOREIGN PATENT DOCUMENTS

| | | | |
|---|---|---|---|
| JP | 10-052347 | A | 2/1998 |
| JP | 2001-224475 | A | 8/2001 |
| JP | 3090500 | | 9/2002 |
| JP | 2008-086728 | A | 4/2008 |
| KR | 20-0284204 | A | 7/2002 |

OTHER PUBLICATIONS

The international search report and opinion is also attached for reference.

* cited by examiner

*Primary Examiner* — Michael Trettel
(74) *Attorney, Agent, or Firm* — Pradip K. Sahu

(57) ABSTRACT

A pillow having positionable inserts is provided. Certain embodiments include inserts that are made from memory foam material formed into a variety of shapes that can assist in correcting the curvature of a user's spine. Some inserts may be made from cylindrical pouches that contain particulate materials. Inserts may be color-coded to correspond to different sizes of inserts or different filling materials. The inserts may be affixed within the pillow or on a bottom end of the pillow with hook and loop fasteners, double stick tape or other fastening means. Certain embodiments may contain measurement indicia, such as an internally located imprinted grid, to assist in precise placement of inserts within the pillow. The measurement indicia can assist physicians in monitoring a patient's progress or in making changes to therapy regimens. Certain embodiments of the pillow may have a cradling end configured to more comfortably cradle a person's head.

14 Claims, 8 Drawing Sheets

PILLOW WITH POSITIONABLE INSERTS

CLAIM FOR PRIORITY

This application claims priority from U.S. Provisional Patent Application Ser. No. 61/325,345 filed on Apr. 18, 2010.

BACKGROUND

Typical pillows are mass produced and designed to try to accommodate entire populations. They are designed merely to provide a cushion for people to slightly elevate their heads and necks while they are sleeping. The pillows are more or less one size fits all, and they can not be easily adjusted to conform to the unique body contour of an individual. For this reason, several companies have developed adjustable pillows. Users can try to adjust the size or shape of these pillows by, for example, inflating them or placing some type of an insert inside them. However, these pillows are difficult to use, and they are not very effective. Specifically, prior art pillows that have inserts are poorly designed because the inserts can only be put in one or two locations. They do not allow for perfect conformance with a user's spine or neck or shoulder. Moreover, these pillows do not allow for a variety of component materials of different sizes, shapes and hardness to be used in the inserts. They do not provide a means to easily position and re-position inserts within the pillow as the user's needs change, and they do not contain a plurality of inserts for each of the top and bottom ends or the middle of the pillow that allow for very precise customization to a user's body. They also do not provide a way to easily adjust the height of the pillow to meet an individual's unique needs.

BRIEF SUMMARY OF THE INVENTION

An improved therapeutic pillow is provided having removable inserts that may be positioned and re-positioned to conform to a user's spine. The pillow has a casing, and it has an encasement or a main body that acts as a substrate on which inserts may be affixed. The casing, also referred to herein as a case or cover, helps to keep the pillow and all of its components together and can be made from terrycloth and fastened by a zipper means. Terry cloth has been found to be very comfortable and absorbent, which makes it desirable for use with a pillow. Alternative materials such as microfiber cloths, terrycloth-spandex blends, cotton-polyester blends or hypoallergenic fabric may be used for the case as well, and alternative fastening means such as hook and loop fasteners or snaps are also contemplated. The pillow encasement may be made from commercially available visco-elastic polyurethane foam ("memory foam") to assist in providing comfort to the user while still providing support to the user's spine. Alternative materials such as those made from microfibers and/or latex, for example, are also contemplated as acceptable.

The encasement may be divided into top and bottom halves. The top half is the part that is in contact with the user's body. In embodiments of the invention that are used as cervical pillows, the user's head rests on the top half of the encasement, which is covered by the casing. The top half of the encasement can have slits made therein to aid in the pillow conforming around the user's head. The size and location of the slits may be modified to provide more or less conformance around the user's body. This is referred to herein as "press control." In the alternative, different types of cuts or indentations within the encasement, such as punch outs, x's, semicircles, or others, can be made to aid in press control.

The inserts placed inside the pillow provide support for the user's body. Particular embodiments may be used in therapy regiments for those who suffer from degenerative diseases of the cervical spine. In such embodiments, the pillow may provide support for the sub-occipital region and the supra-occipital region of the user's head. It can also provide support to the cervical spine, and it can be used to tilt a user's head in a correct orientation. For example, it can be used to control the support in the occipital—cervical junction. In fact, such embodiments of the pillow can be used in therapy regimens to correct the curvature of the spine through gradually re-positioning inserts and changing their sizes, shapes or hardness as a patient progresses in his therapy.

In an alternative embodiment, the encasement or main body can be in the form of a single piece with a unique contoured shape that cradles the head of a user and allows the user's shoulder to slide underneath at least a portion of the pillow. In such embodiments, the inserts can be placed on the outside of the pillow to adjust the height and other characteristics of the pillow so that the pillow better conforms to the user's unique body size and shape. The inserts can be shaped in such a way that height of the pillow increases without a change in the pillow's overall shape.

The pillows can be made from materials such as memory foam. They can also be made, for instance, by placing liquids, gels or particulate matters within suitable enclosing means such as pouches. For example, the particulate matters may be buckwheat, and the enclosing means may be a cloth pouch. The inserts can also have covering materials affixed to them or to any portion of them. The covering materials can be made from fabrics such as felt, hypo-allergenic fabrics or microfiber cloths for example. They can be made into different shapes and sizes to aid in supporting the user's body. They can also have different colors corresponding to the different sizes, shapes, hardness, component materials or level of conformity. The inserts may be affixed to the encasement or main body within the pillow using suitable affixing means, such as hook and loop fasteners, snaps, or double sided tape, for example. It has been found that if the fasteners are all hook portions of hook and loop fasteners, it makes it easier to fasten the inserts to the memory foam or felt substrate materials.

Certain embodiments of the pillow include measurement indicia in the inner portion of the pillow to more accurately place the inserts within it. The measurement indicia is preferably a grid that is imprinted on the bottom half of the encasement, but other means are contemplated. The measurement indicia can optionally be printed on materials such as felt, fabrics, and similar materials that can be adhered or affixed to the encasement. The inserts may be affixed and positioned and re-positioned more easily using the measurement indicia. This feature is particularly beneficial in instances in which the user is receiving therapy to correct the curvature of the cervical spine. A physician can note the exact size, shape, component materials and position of the inserts and make modifications as the therapy progresses. In addition, a doctor can write on the interior surface of the encasement certain things such as patient name, dates of therapy, colors of inserts, measurements of cervical curvature over time, and other notes related to the therapeutic protocols the patient is following.

The pillow disclosed herein is comfortable, simple to use, easy to manufacture, inexpensive to produce and very effective when used therapeutically. These and other features and advantages of the invention are described in more detail below.

BRIEF DESCRIPTION OF THE DRAWINGS

FIG. 16 is a top perspective view of parallelogram-shaped insert.

DETAILED DESCRIPTION OF THE PREFERRED EMBODIMENTS

Figure 1:
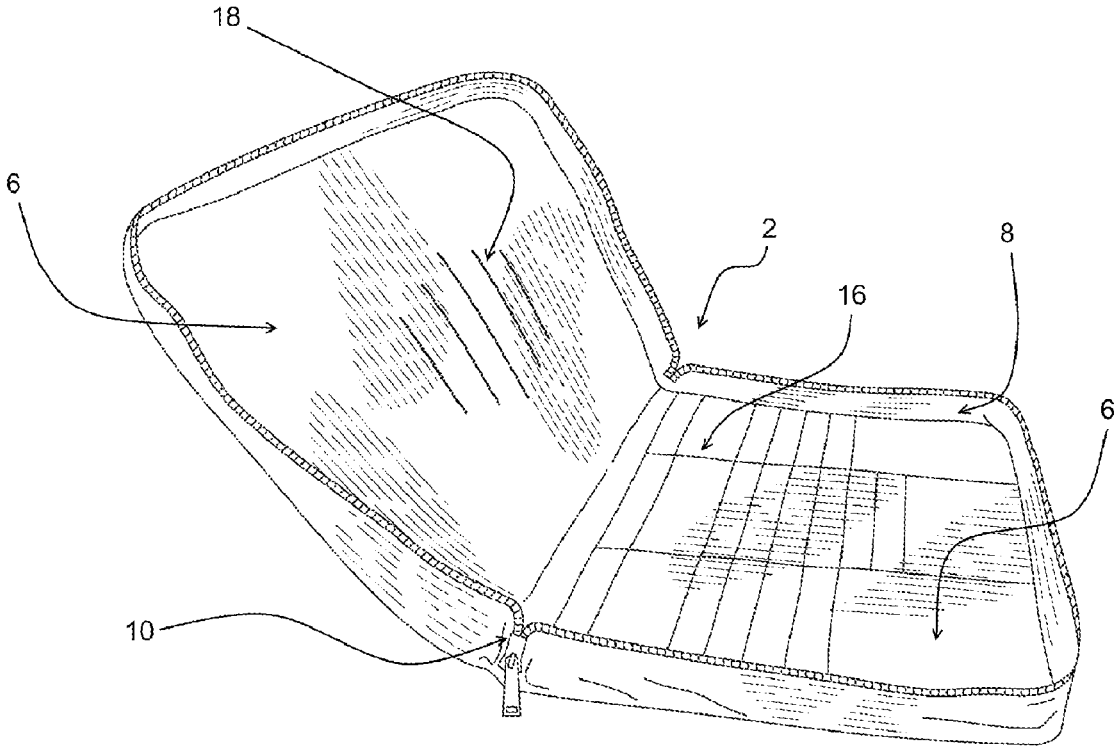
FIG. 1 is a top perspective view of an embodiment of the pillow in which the pillow is partially opened to show the interior portion.
Figure 2:
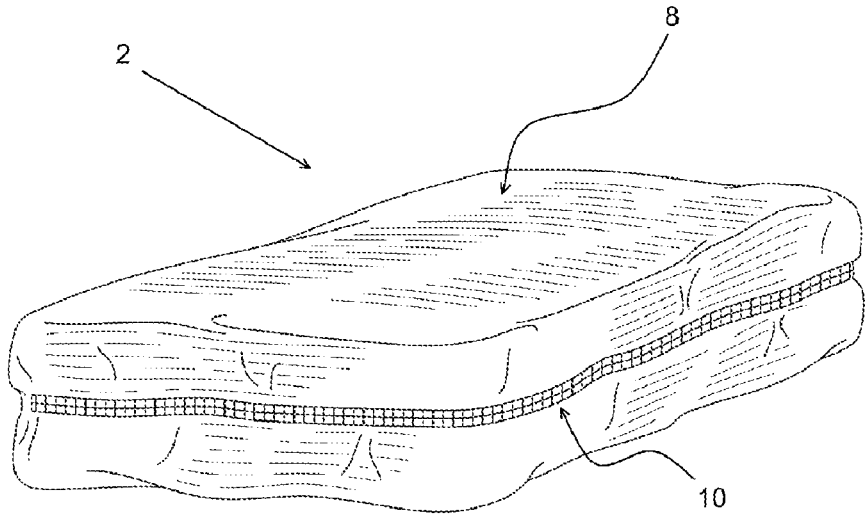
FIG. 2 is a top perspective view of an embodiment of the pillow in which the pillow is in a closed position.
Figure 3:
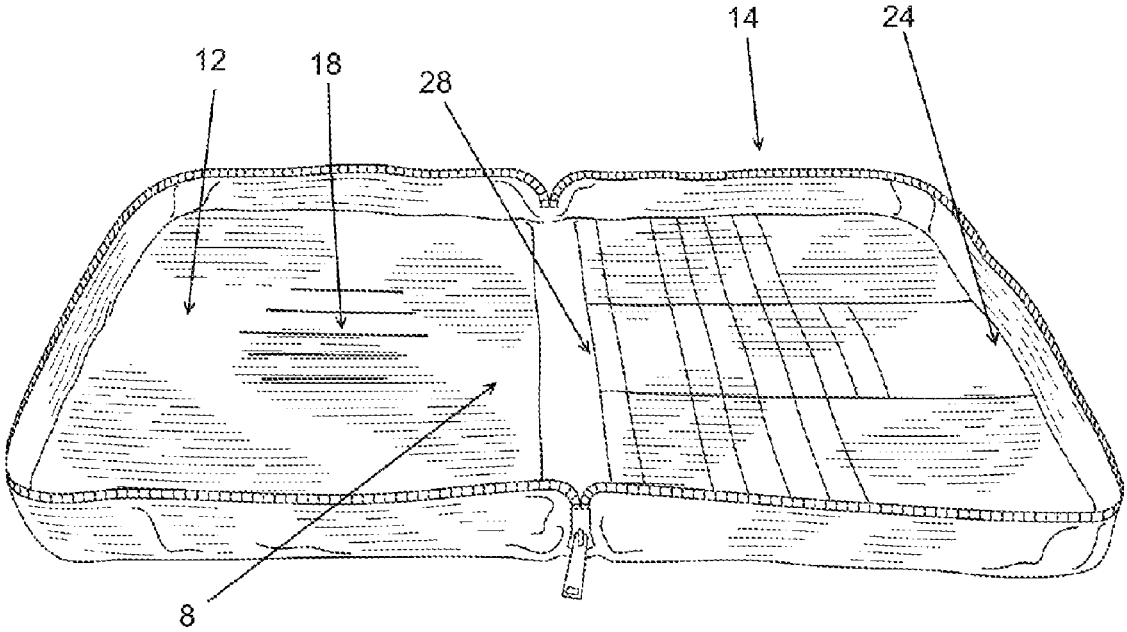
FIG. 3. is a top perspective view of an embodiment of the pillow in which the pillow is opened and laid flat to show the interior portion.

Referring now to FIGS. 1 through 3, the present pillow 2 has removable inserts 4, 5 that may be positioned and repositioned to conform to a user's body. The pillow has a casing 6, and it has an encasement 8 or main body 8 on which the inserts 4, 5 may be affixed. In the embodiment depicted in the drawings, the casing 6 is made from terrycloth and fastened by a zipper means 10. The terrycloth and zipper materials may be purchased from numerous suppliers known in the trade such as Dongguan Zhengwei Fashion & Case Accessories of China, Ho Yip Trading Company of Hong Kong and numerous other fabric supply sources throughout the USA. Although other shapes and sizes are contemplated, the pillow may have an overall rectangular shape with a length of twenty one inches, a width of fourteen inches and a thickness of four inches when in the closed position.

In a preferred embodiment, the pillow encasement 8 is made from memory foam. It has been discovered that memory foam has unique characteristics related to the spinal support and contour functions of the pillow, which makes memory foam a particularly suitable component material for the invention. The encasement 8 shown in the drawings is made from a single rectangular sheet of memory foam that is thirty inches long, twenty inches wide and three quarters of an inch thick. The foam may be purchased from numerous sources known in the industry such as the Foam Factory of Michigan, CutFoam of England, and Foam Source of Colorado. In an embodiment, the encasement 8 has a top half 12 and a bottom half 14. The bottom half 14 of the encasement 8 shown in certain of the figures has a felt covering adhered to it, which aids in the imprinting of the measurement indicia 16 described herein. The felt also provides for a more effective substrate to which hook and loop fasteners can adhere. Felt material with an adhesive backing may be purchased from numerous sources known in the industry such as Sutherland Felt Company of Michigan, the Felt House of South Korea, or Aetna Felt Corporation of Michigan.

The top half 12 of the encasement 8 shown in the drawings has a press control means 18 in the form of slits 18 made therein to aid in the pillow 2 conforming around the user's head. There are four slits 18 cut in the encasement 8 shown in the drawings, and they are located in the center of the top half 12. The length of the central slit is five and one half inches, the length of the two slits on either side of the central slit is five inches, and the length of the outermost slits is three and one half inches. Other sizes, shapes and orientations of the press control means 18 are contemplated. The press control means 18 can be imparted using a knife, scissors or other suitable means more adaptable for mass production as are known in the art.

Figure 4:
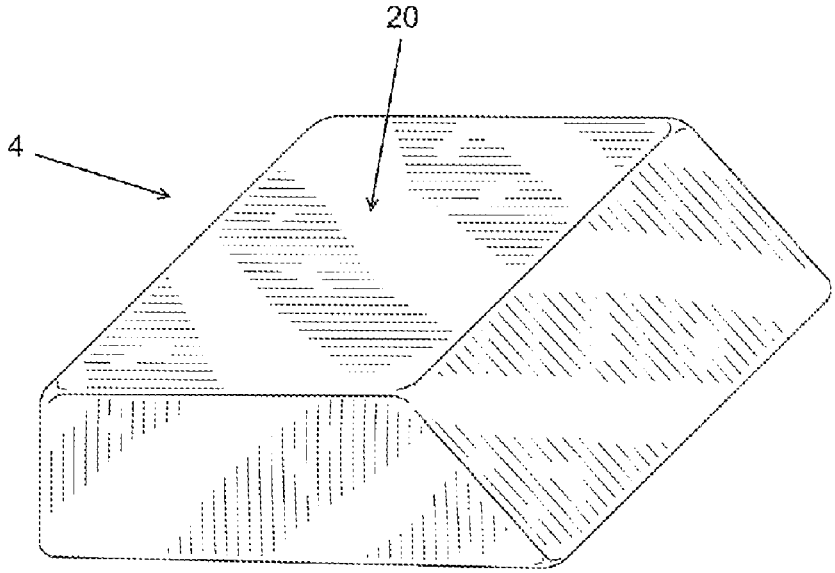
FIG. 4. is a top perspective view of a wedge shaped insert.
Figure 5:
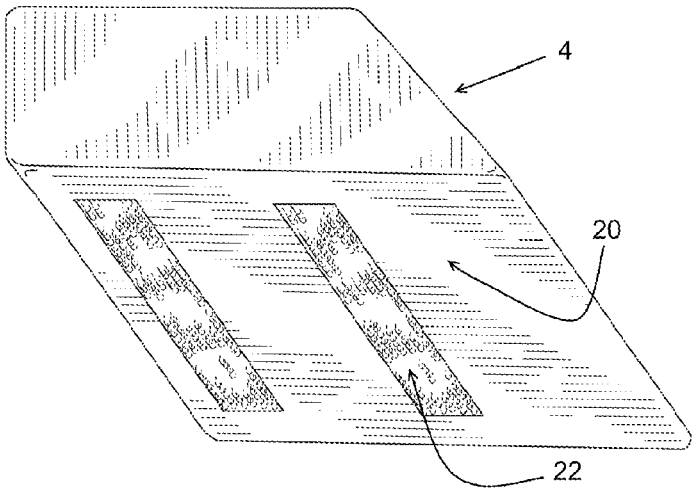
FIG. 5. is a bottom perspective view of the insert of FIG. 4.

The inserts 4, 5 placed inside the pillow 2 shown in the drawings are made from different types of materials. A wedge shaped insert 4 that is made from memory foam and that has a felt covering 20 is shown in FIGS. 4 and 5. Although various shapes and sizes are contemplated, this particular insert 4 has a top portion that is rectangular, four inches wide and seven inches long. It has a bottom portion that is four and one half inches wide and seven inches long. It has a thickness of two inches. Hook and loop fasteners 22 are adhered to the bottom of the insert 4 to ensure that it does not move when positioned in the pillow 2. An alternative fastener 22 that was developed and which has been discovered to be surprisingly effective is a "double sided" hook fastener. This is made by affixing back to back two inch-long strips of the hook side of a hook and loop fastener system. Such fastener 22 has hooks on both sides, and these hooks can latch on to the inserts 4 as well as the encasement 8 of the pillow 2, for example.

Figure 10:
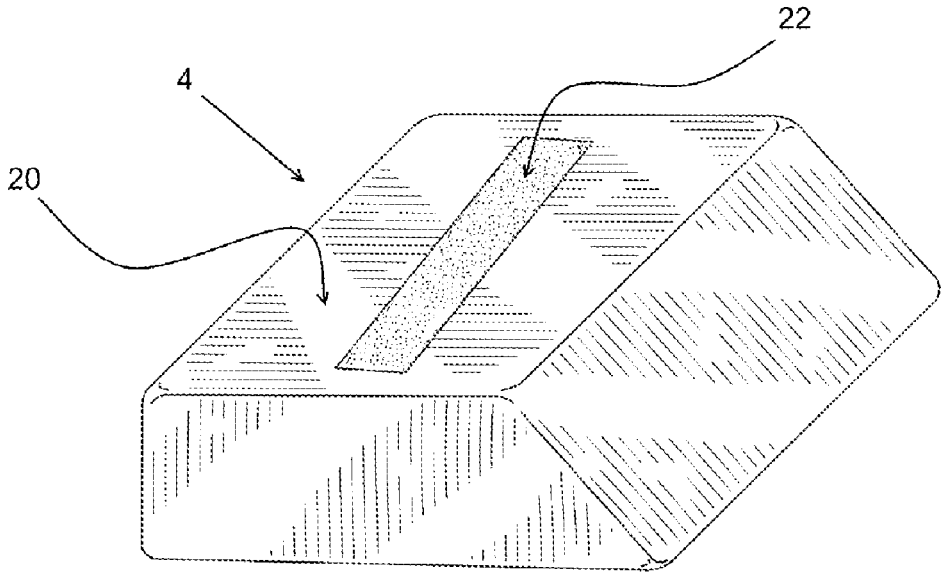
FIG. 10. is a top perspective view of an insert with a hook and loop fastening means affixed to its top portion.
Figure 11:
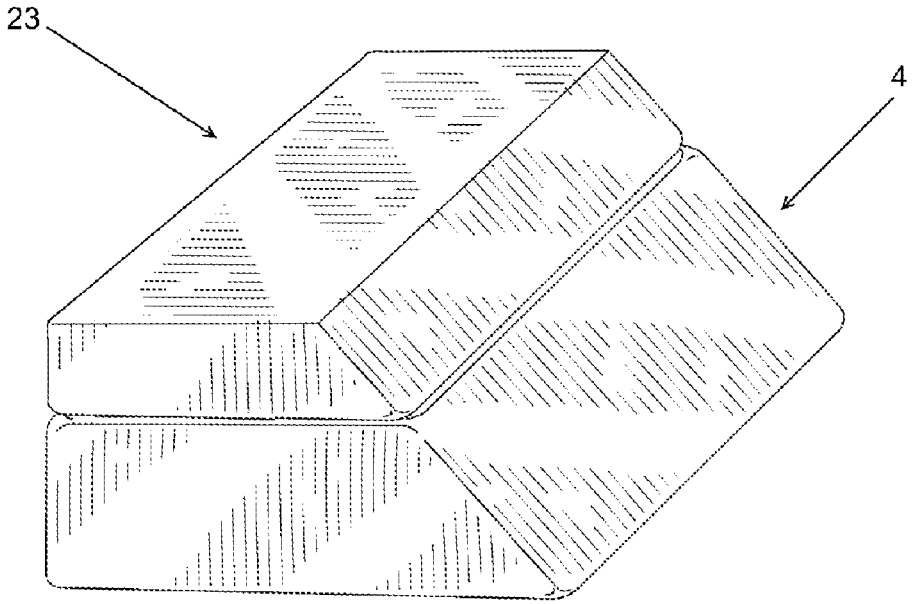
FIG. 11. is a top perspective view of an insert attached to the top of another insert.

Inserts 4 may have fasteners 22 affixed to their tops in addition to their bottoms, as shown in FIG. 10. In such embodiments, two sets of inserts 4 can be stacked on top of each other to increase their height. This is desirable because each insert 4,5 can have its height adjusted by placing another insert 4, 5 above or below it. Specialized height adjustment inserts 23 designed specifically for attaching atop other inserts 4 can be used, as is shown in FIG. 11. The use of inserts 4,5 is also desirable because it means that a user can adjust the size, shape and hardness parameters of the pillow 2 simply by purchasing and changing the inserts 4,5 without having to purchase an entirely different pillow.

Figure 9:
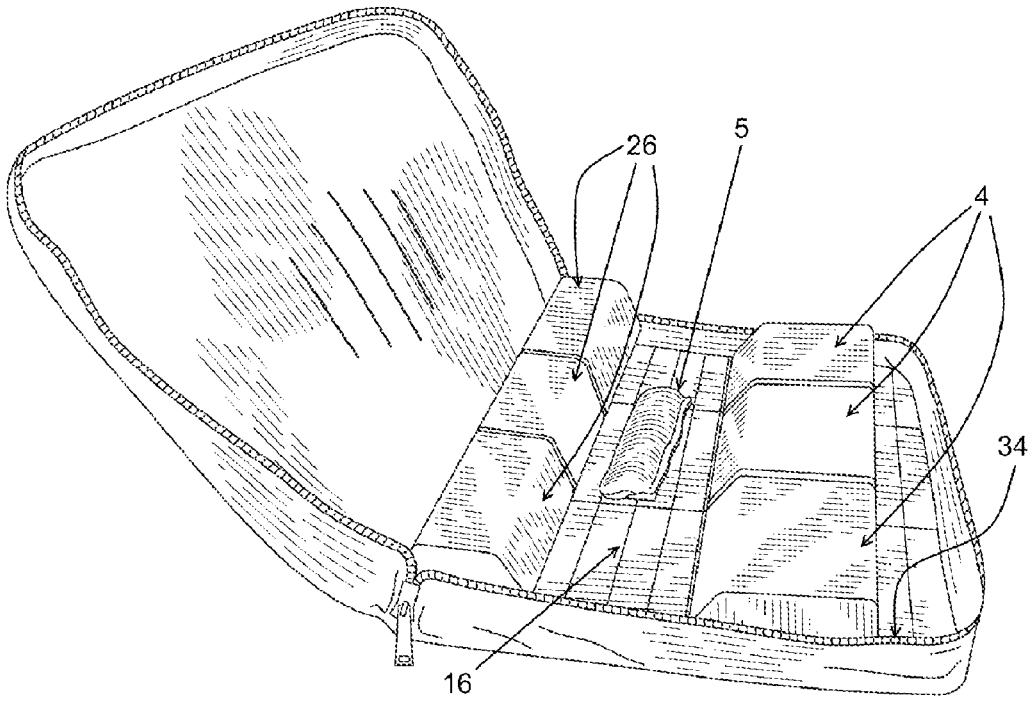
FIG. 9. is a top perspective view of an embodiment of the pillow in which some more inserts are installed.

A preferred embodiment depicted in FIG. 9 contains three of these inserts 4 positioned side by side along the lower edge 24 of the pillow 2. FIG. 9 also depicts three wedge shaped inserts 26 along the upper edge 28 of the pillow. These inserts 26 have a top portion that is rectangular, two and one quarter inches wide and seven inches long. These inserts 26 have a bottom portion that is rectangular, three and one quarter inches wide and seven inches long. These inserts 26 have a thickness of two and one quarter inches. It has been found that the difference in thicknesses of the inserts 4 located along the lower edge 24 compared to the thicknesses of the inserts 26 located along the upper edge 28 is very beneficial when used in therapeutic cervical pillows. The differences make for a pillow 2 that more readily supports the patient's head and spine at the appropriate height. Alternatively, a single insert 4 can be of the same length of the three inserts 4 shown in FIG. 9 and traverse the entire length of the pillow 2. Such embodiments may be more comfortable for users because there are fewer junctions or spaces that a user's head could feel when resting on the pillow 2.

Figure 6:
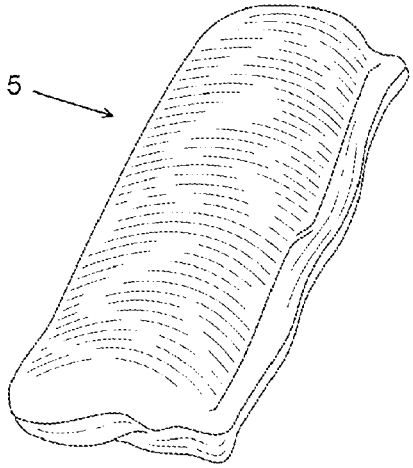
FIG. 6. is a top perspective view of a tubular insert.
Figure 7:
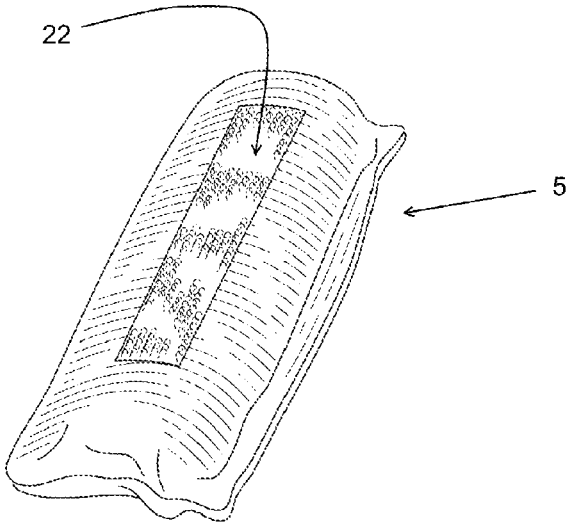
FIG. 7. is a bottom perspective view of the insert of FIG. 6.

FIGS. 6 and 7 depict a tubular insert 5. In an embodiment, the tubular insert 5 is made with a cloth pouch filled with buckwheat. Although other shapes and sizes are contemplated, the insert 5 shown in the figures is six inches long, two and one half inches wide and three quarters of an inch thick. Alternative casing materials such as terrycloth, plastic, neoprene or microfiber cloths may be used to make the tubular inserts 5. Other filler materials such as rice hulls, cracked wheat, and pulverized coconut husks can be used as well. The foam, felt, cloth and buckwheat that can be used to make the inserts 4, 5, 26 are relatively generic and can be obtained from many sources as known in the art, some of which are noted above.

FIG. 16 depicts an alternative insert 4 that is shaped like a parallelogram. This shape has been found to be beneficial because when a user rests his head on these inserts 4, he is less likely to feel the insert's edges A against his head. This is because the spacing underneath the edge A allows the edge A to move downward to conform more readily with the user. This results in a more a more comfortable pillow.

As noted above, cloth and felt having different colors can be used on the inserts 4, 5, 26 to more easily identify a corresponding size, shape or hardness. This will help physicians, patients or other end users of the pillow 2 more easily identify which insert 4, 5, 26 they should use in a given application. For example, inserts 4 that are to be located on the lower edge 24 can be colored green. Inserts 26 located on the upper edge 28 can be colored yellow. Blue dots can be placed on inserts 4, 26 that are two inches thick, while red dots can be placed on inserts 4, 26 that are two and one half inches thick. Many different color combinations and identifying features can be used, but simple and easy to use combinations would make the pillow 2 more user friendly.

A surprising effect is felt when using wedge shaped inserts 4 on the front most and back most portions of the bottom half 14 of the encasement 8 and one tubular insert 5 in the middle of the bottom half 14 as shown in FIG. 9. When the user rests his head with the occipital portion directly in the center of the pillow 2, the user feels substantial support on the occiput. Amazingly, when the user turns his head to either side, the ears of the user feel very little pressure and no discomfort at all. This means that the user will get the maximum therapeutic effect with regard to support of the cervical spine, but he will have no discomfort when he changes his position to sleeping on one side or the other. This will aid patients in adhering to their therapy regimens that incorporate the pillow 2. In fact, one advantage of such embodiments of the pillow 2 is that the user can feel support no matter where he rests his head and neck along the left and right sides of the pillow 2, whereas in other therapeutic pillows the user must have his head in the center to receive the therapeutic effect.

Figure 8:
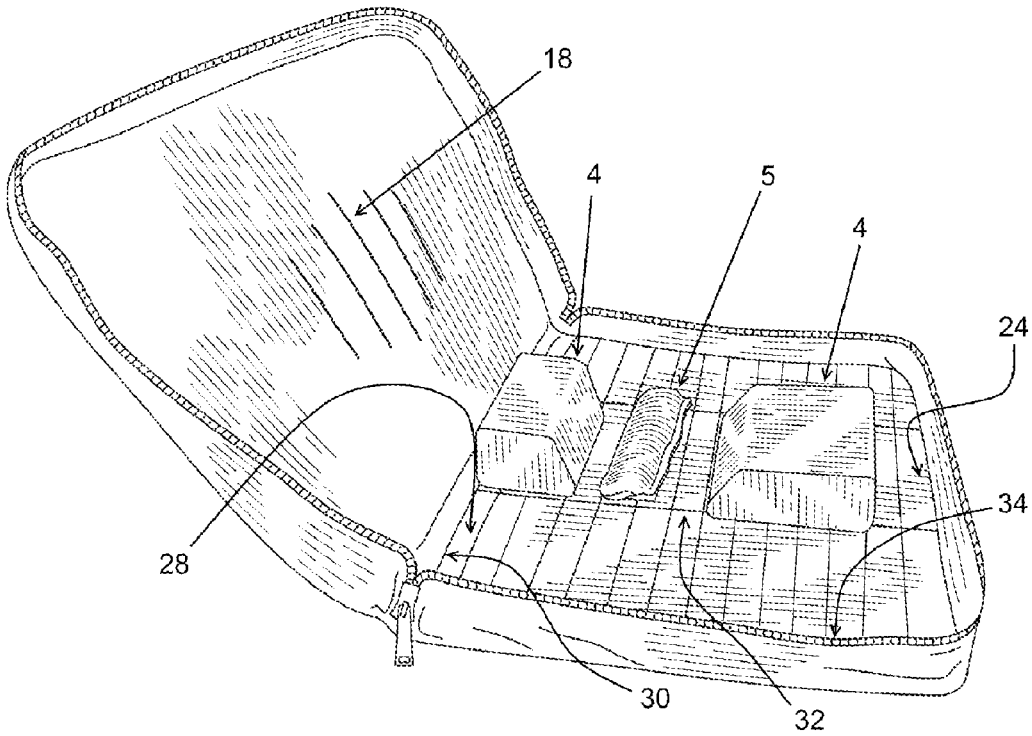
FIG. 8. is a top perspective view of an embodiment of the pillow in which some inserts are installed.
Figure 12:
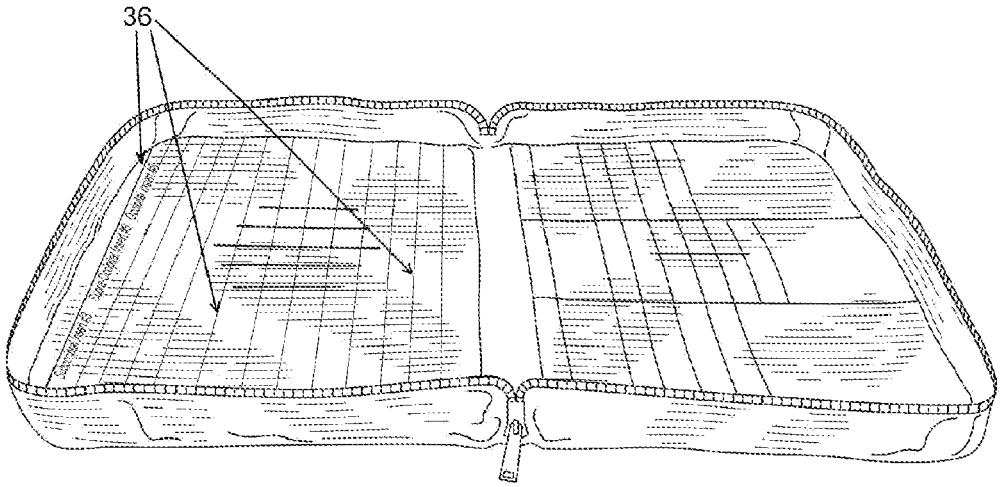
FIG. 12. is a top perspective view of an embodiment of the pillow showing a means on which notes may be written.

Certain embodiments of the pillow 2 include measurement indicia 16 in the inner portion of the pillow to more accurately place the inserts 4, 5, 26 within it. The measurement indicia 16, as shown in the drawings, is preferably a grid that is imprinted on the bottom half of the encasement 14. The grid can be in a form that includes a horizontal x-axis 30 that runs along the width of the encasement 8 from left to right and a vertical y-axis 32 that runs along the length of the encasement 8 from top to bottom. In a preferred embodiment shown in FIGS. 8 and 9, the x-axis 30 has lines dropping perpendicularly from it at seven inches and thirteen inches from a left edge 34 of the encasement 8. Intersecting such lines are preferably horizontal lines drawn across every one inch of the y-axis 32. This grid work aids users in very easily positioning and re-positioning the inserts 4, 5, 26 when desired. This feature is particularly beneficial in instances in which the user is receiving therapy to correct the curvature of the cervical spine. A physician can note the exact size, shape, component materials and position of the inserts 4, 5, 26 and make modifications as the therapy progresses. In some embodiments as shown in FIG. 12, a doctor can write upon a notation means 36 in the form of horizontal lines located on the interior surface of the encasement 8. The physician can note things such as a patient's name, dates of therapy, colors of inserts, measurements of cervical curvature over time, and other notes related to the therapeutic protocols.

Figure 13:
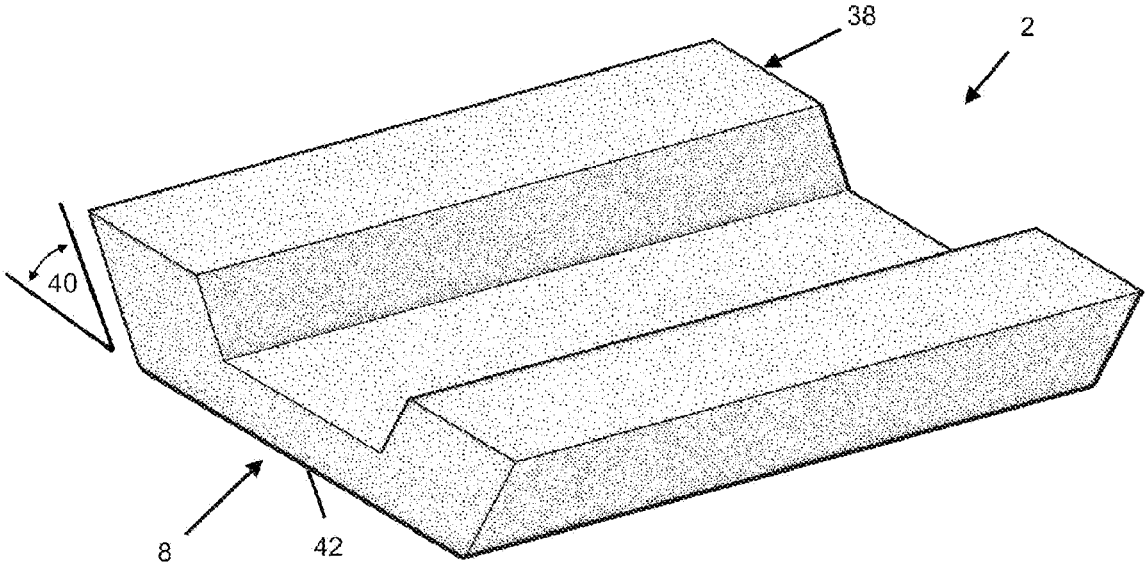
FIG. 13. is a top perspective view of an embodiment of the pillow with a unique contour. The pillow is shown without the casing.

FIG. 13 depicts an alternative embodiment of the pillow main body 8. The casing 6 is not shown in this series of figures. The pillow main body is somewhat "U"-shaped such that a user's head is cradled by the pillow 2 and the user's shoulder can slide underneath one of the cradling ends 38 if a user is lying down sideways. The user's head and neck are also cradled if the user is lying down on his back. This shape is unique because it is counter-intuitive. One would think, and prior art pillows likely demonstrate, that it is necessary to have a thick and unyielding support underneath a user's neck to ensure that there is adequate lift. However, it was discovered that there is surprisingly more effectiveness and comfort when the lifting support or cradling means can flatten out or yield to the user's weight.

Figure 14:
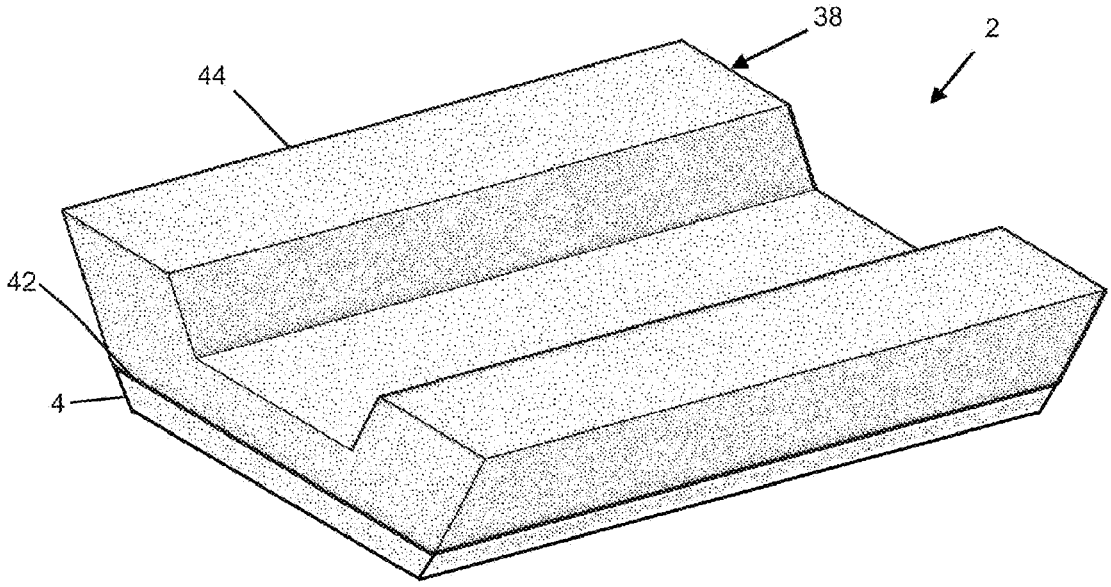
FIG. 14 is a top perspective view of the pillow shown in FIG. 13 with an insert attached to increase the height of the pillow.
Figure 15:
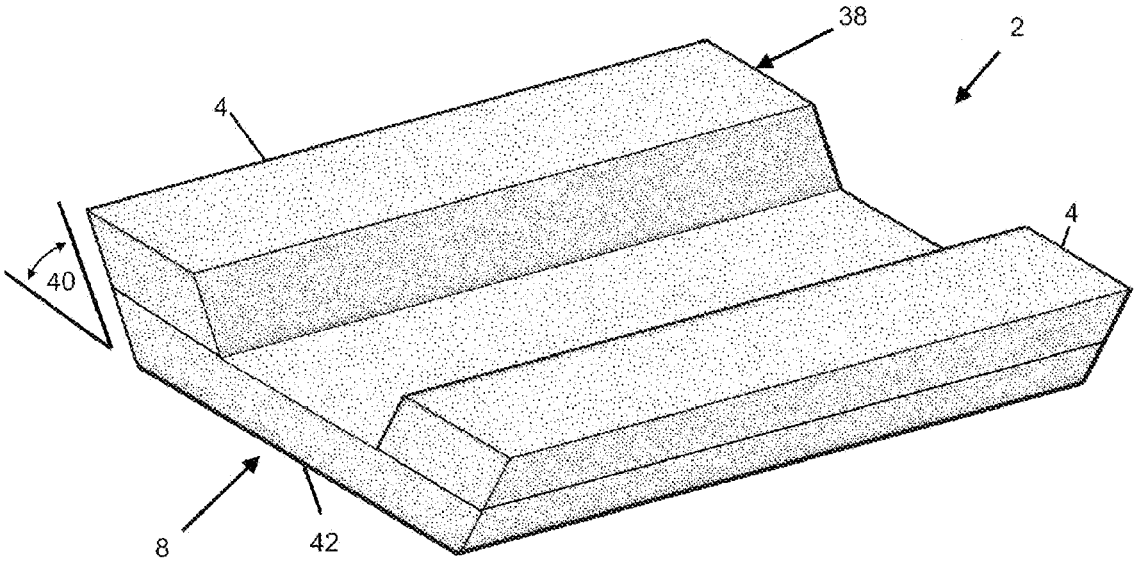
FIG. 15 is a top perspective view of an alternative embodiment of a pillow with a unique contour in which the cradling end comprises neck rest inserts that are removable.
Figure 18:
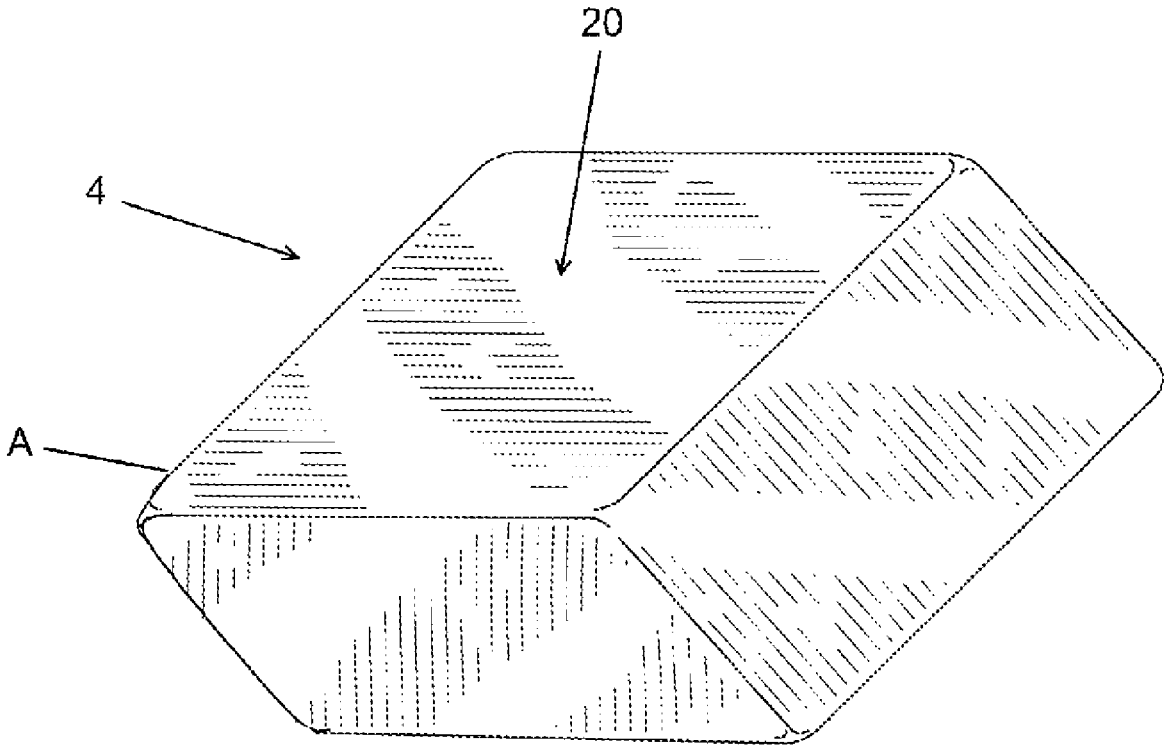

The cradle angle 40 can range from between fifteen degrees from horizontal to about sixty degrees from horizontal to fit the unique needs of an individual user. A cradle angle 40 of forty five degrees, for example, has been shown during experimental tests to be particularly effective for a wide range of patients. In addition, a lifting insert 4 such as the one shown in FIG. 14 may be attached to the bottom portion 42 of the main body 8 to create more lift. Moreover, a pillow 2 with this unique contour may be made with a main body 8 that contains the base portion 42 and the neck rest portions 44 as one piece as shown in FIG. 13, or it may be made with a main body 8 that is separate from the neck rest inserts 4 as shown in FIG. 15. These neck rest inserts 4 can have various shapes and they can have different amounts of rigidity to suit the particular needs or desires of each individual user.

While particular embodiments of the present pillow with one or more inserts has been described herein, it will be appreciated by those skilled in the art that changes and modifications may be made thereto without departing from the invention in its broader aspects and as set forth in the following claims.

I claim:

1. A pillow comprising:

an encasement;

one or more inserts;

measurement indicia within the pillow, the measurement indicia comprising a grid that is imprinted within the pillow, the grid comprising a horizontal x-axis and a vertical y-axis; and vertical lines drawn across the x-axis and horizontal lines drawn across the y-axis forming a rectangular gridwork.

2. The pillow of claim 1 wherein:

the vertical lines are drawn across the x-axis at seven inches and at thirteen inches from a left side of a bottom half of the encasement to a right side of the bottom half of the encasement; and the horizontal lines are drawn across the y-axis every one inch from a top side of the bottom half of the encasement to a bottom side of the bottom half of the encasement.

3. The pillow of claim 1 wherein:

the encasement is made from memory foam; and at least one of the inserts is made with memory foam with a felt covering.

4. The pillow of claim 1 wherein:

at least one of the inserts is secured to the encasement using double sided hook fasteners.

5. The pillow of claim 1 wherein:

at least one of the inserts is color coded to correspond to different insert sizes.

6. The pillow of claim 1 wherein:

the encasement contains a press control feature, said feature comprising slits through the encasement.

7. The pillow of claim 1 further comprising:

a casing; and wherein the casing is made from terrycloth and closed using a zipper means.

8. The pillow of claim 1 further comprising:

a casing made from microfibers.

9. The pillow according to claim 1 wherein one of the one or more inserts is affixed to another of the one or more inserts.

10. The pillow according to claim 1 wherein one of the one or more inserts is affixed on top of another of the one or more inserts using a double sided hook fastener.

11. A pillow comprising:

a casing;

an encasement with a press control feature, said feature comprising slits through the encasement;

at least one positionable insert;

measurement indicia imprinted within the pillow;

wherein the measurement indicia comprises a grid;

wherein the press control feature is selected from the group consisting of lines, holes, partial cutouts, indentations and x's;

wherein one of the inserts is a tubular insert containing buckwheat and positioned in a center of the encasement;

and wherein other of the inserts are wedge shaped inserts located along an upper edge of the pillow and along a lower edge of the pillow.

12. A pillow comprising:

a casing; and a main body with at least one cradling end having a cradle angle between fifteen degrees and sixty degrees;

a depression along a longitudinal axis of the pillow;

the cradle angle along a longitudinal side of the pillow;

the cradle angle defined by the cradling end and a horizontal surface on which the pillow is rested;

the cradling end and the horizontal surface defining a space such that a user's shoulder may be under the cradling end while a user's head is resting on the main body when the cradling end is in an uncompressed position.

13. The pillow of claim 12 further comprising a positionable insert configured to attach to a bottom portion of the main body.

14. The pillow of claim 13 wherein the cradling end includes a neck positioning insert.

* * * * *